US007648392B2

(12) United States Patent
Chambers et al.

(10) Patent No.: US 7,648,392 B2
(45) Date of Patent: Jan. 19, 2010

(54) QUICK CONNECTOR FOR MULTI-MEDIA

(75) Inventors: Kenith W. Chambers, Batesville, IN (US); John Boyd Havener, Indianapolis, IN (US); Terry J. Stratman, Villa Hills, KY (US)

(73) Assignee: Hill-Rom Services, Inc., Wilmington, DE (US)

( * ) Notice: Subject to any disclaimer, the term of this patent is extended or adjusted under 35 U.S.C. 154(b) by 609 days.

(21) Appl. No.: 11/300,667

(22) Filed: Dec. 13, 2005

(65) Prior Publication Data

US 2006/0156473 A1 Jul. 20, 2006

Related U.S. Application Data

(60) Provisional application No. 60/636,252, filed on Dec. 15, 2004.

(51) Int. Cl.
*H01R 33/945* (2006.01)

(52) U.S. Cl. ..... 439/577; 285/124.1; 403/218; 141/37; 141/313; 5/655.3; 5/713

(58) Field of Classification Search ..... 285/123.2, 285/123.1, 131, 124.1–124.5, 123.15, 123.16, 285/129.1, 148.27; 403/218; 141/37, 54, 141/99, 285, 313, 382; 5/423, 655.3, 706, 5/727, 713; 340/575; 137/883; 15/3.5, 344, 15/345, 246.2; 138/114
See application file for complete search history.

(56) References Cited

U.S. PATENT DOCUMENTS

| | | | | | |
|---|---|---|---|---|---|
| 3,163,707 | A * | 12/1964 | Darling | 174/47 |
| 3,654,792 | A * | 4/1972 | Mead | 72/391.8 |
| 4,211,457 | A * | 7/1980 | Meadows | 439/192 |
| 4,517,404 | A * | 5/1985 | Hughes et al. | 174/47 |
| 4,949,413 | A | 8/1990 | Goodwin | |
| 5,005,240 | A * | 4/1991 | Vrzalik | 5/713 |
| 5,539,942 | A | 7/1996 | Melou | |
| 5,594,963 | A * | 1/1997 | Berkowitz | 5/713 |
| 5,647,079 | A | 7/1997 | Hakamiun et al. | |
| 5,794,289 | A | 8/1998 | Wortman et al. | |
| 5,944,494 | A | 8/1999 | Soltani et al. | |
| 6,206,654 | B1 | 3/2001 | Cassidy | |
| 6,295,675 | B1 * | 10/2001 | Ellis et al. | 5/710 |
| 6,467,113 | B2 | 10/2002 | Ellis et al. | |
| 6,668,408 | B2 | 12/2003 | Ferrand et al. | |
| 6,735,799 | B1 | 5/2004 | Ellis et al. | |
| 6,760,939 | B2 | 7/2004 | Ellis et al. | |
| 6,829,796 | B2 | 12/2004 | Salvatini et al. | |
| 7,077,165 | B2 * | 7/2006 | Takasaki et al. | 138/108 |
| 2006/0075559 | A1 * | 4/2006 | Skinner et al. | 5/615 |

* cited by examiner

*Primary Examiner*—Timothy L Maust
*Assistant Examiner*—Jason K Niesz
(74) *Attorney, Agent, or Firm*—Barnes & Thornburg LLP

(57) ABSTRACT

A connector apparatus for connecting an air supply unit and a mattress or cushion.

20 Claims, 12 Drawing Sheets

QUICK CONNECTOR FOR MULTI-MEDIA

CROSS-REFERENCE TO RELATED APPLICATIONS

This application claims the benefit of U.S. Provisional Patent Application Ser. No. 60/636,252, titled "Quick Connector for Multi-Media", filed Dec. 15, 2004, the disclosure of which is expressly incorporated by reference herein.

The present application is related to U.S. patent application Ser. No. 11/119,980, entitled "Pressure Relief Surface", U.S. patent application Ser. No. 11/119,991, entitled "Patient Support Having Real Time Pressure Control", U.S. patent application Ser. No. 11/119,635, entitled "Lack of Patient Movement Monitor and Method", and U.S. patent application Ser. No. 11/120,080, entitled "Patient Support", all of which were filed on May 2, 2005, all of which are assigned to the assignee of the present invention, and all of which are incorporated herein by this reference.

The present application is also related to U.S. Provisional Patent Application Ser. No. 60/697,723, entitled "Patient Support", U.S. Provisional Patent Application Ser. No. 60/697,748, entitled "Pressure Control for a Hospital Bed", and U.S. Provisional Patent Application Ser. No. 60/697,708, entitled "Control Unit for a Patient Support" all of which were filed Jul. 8, 2005, all of which are assigned to the assignee of the present invention, and all of which are incorporated herein by this reference.

BACKGROUND

It is known to provide hospital beds with a variety of types of mattresses including inflatable portions. It is also known to provide hospital beds which perform functions such as the prevention/treatment of decubitus ulcers (bedsores), pulmonary rotational therapy, or percussion/vibration therapy. Additionally, it is known to use inflatable mattresses with a variety of inflatable cell/zone structures. Examples of inflatable patient supports and functions of a mattress including cell/zone structures are disclosed in U.S. Pat. No. 4,949,413 to Goodwin, U.S. Pat. No. 5,647,079 to Hakamiun et al., and U.S. Provisional Application Ser. No. 60/567,215 to Balaton et al., which are all assigned to the assignee of the present invention and the disclosures of which are expressly incorporated by reference herein.

It is also known to provide an air supply device for use in providing fluid to an inflatable mattress or cushion. An example of one such device is disclosed in U.S. Pat. No. 6,735,799 to Ellis et al., which is assigned to the assignee of the present invention and the disclosure of which is expressly incorporated by reference herein.

SUMMARY OF THE INVENTION

The present invention may comprise one or more features recited in the appended claims and/or one or more of the following features or combinations thereof.

The present invention relates to a connector for use with a mattress, pad, cushion, or bladder for a patient support such as a sleeping and/or seating surface. More particularly, the present invention relates to a quick connector for use with an air supply for an inflatable mattress.

In accordance with one aspect of the present dislcosure, a connector is provided for operably coupling an air supply device to an inflatable mattress or cushion. Additional features and advantages of the invention will become apparent to those skilled in the art upon consideration of the following detailed description of illustrated embodiments exemplifying the best mode of carrying out the invention as presently perceived.

In accordance with another aspect of the present disclosure there is provided a connector apparatus to couple an air supply apparatus to a mattress. The connector apparatus includes a connector assembly coupled to the air supply apparatus, and a hose assembly, coupled to the connector assembly. The hose assembly includes a first air hose having an interior region, and a second air hose and a cable both of which are located within the interior region of the first air hose.

In still another aspect of the present disclosure there is provided a connector apparatus to connect an air supply unit to an inflatable mattress including a low air loss therapy device. The connector apparatus includes a connector assembly, coupled to the air supply unit and a hose assembly, coupled to the connector assembly. The hose assembly includes a first hose, a second hose, and a cable, wherein the first hose is adapted to be coupled to the low air loss therapy device, to supply air to the low air loss therapy device. The second hose is adapted to be coupled the inflatable mattress for inflation thereof. The cable is adapted to be coupled to the mattress to provide electrical communication to the mattress.

BRIEF DESCRIPTION OF THE DRAWINGS

The detailed description of the drawings particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

In accordance with the present invention, a connector apparatus is provided to operably couple an air supply unit to an inflatable mattress or cushion. The inflatable mattress or cushion includes at least one inflatable bladder.

Figure 1:
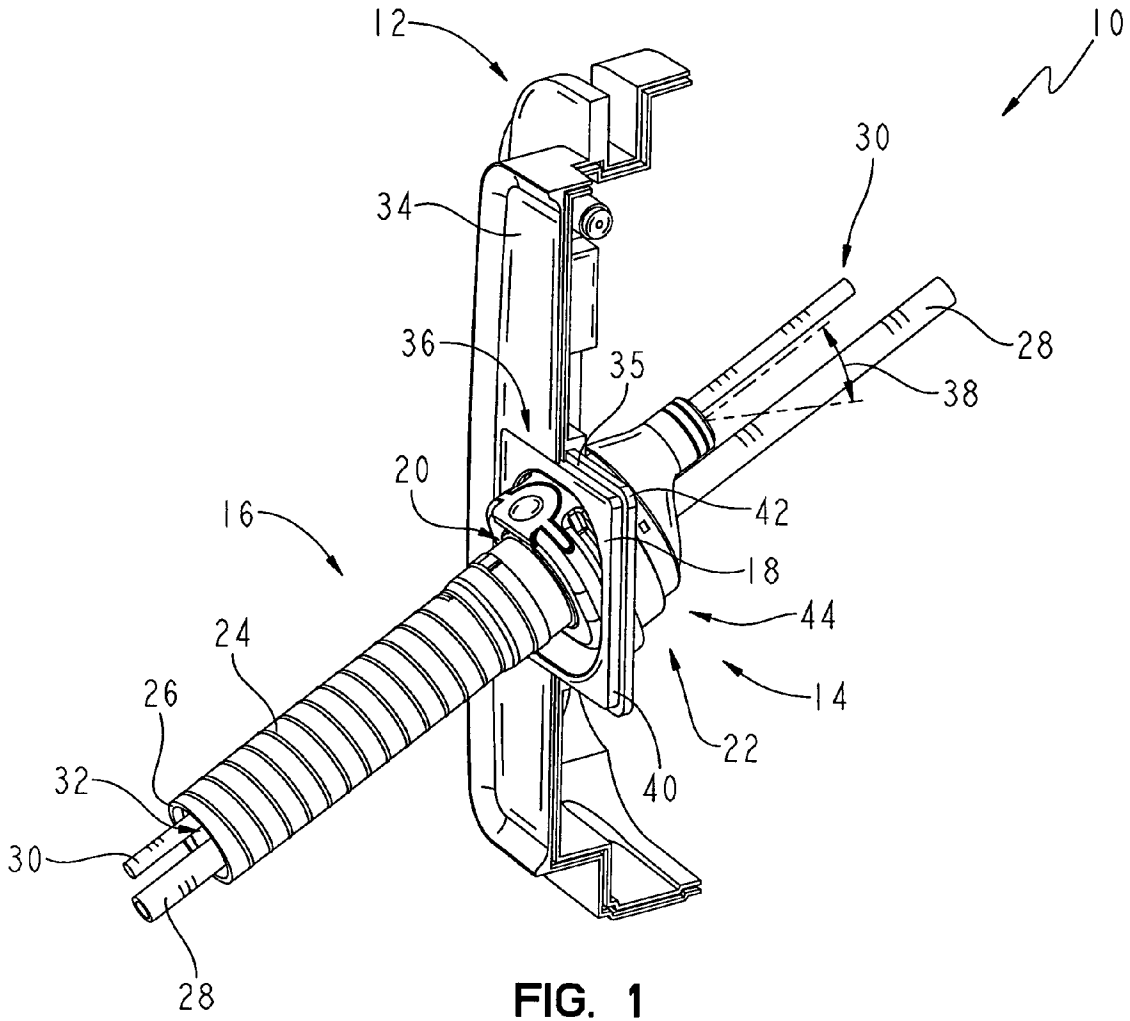
FIG. 1 is a perspective view of one embodiment of a connector device showing a cutaway portion of an air supply unit, a connector assembly coupled to the air supply unit, and a hose.

As shown in FIG. 1, a connector apparatus 10 configured to be coupled to an air supply unit 12 includes a connector assembly 14 coupled to air supply unit 12, and a hose assembly 16 coupled to connector assembly 14. Connector assembly 14 includes a first connector 18, a second connector 20, and a connector body 22 configured to be coupled to first connector 18.

Hose assembly 16 includes a main hose 24 including a housing 26, a secondary hose 28, and a data cable 30. Both secondary hose 28 and data cable 30 are located within an inner region 32 of main hose 24. Interior region 32 is defined at least in part by wall 26.

Secondary hose 28 is configured to provide high pressure air to a mattress or cushion (not shown). Low pressure, high volume air is provided to a mattress or cushion through main hose 24. In this way, a hose assembly 16 provides both the capability of inflating the mattress, providing low air loss therapy inside a single easy to handle housing 26.

In the illustrated embodiment, a data cable 30 is also provided within interior region 32 of housing 26. Data cable 30 is configured to provide electrical communication including power and network communication to the mattress (not shown). One example of a suitable data cable 30 is Part Number M2224 Power Data Cable, 8 Cond, 20AWG from Manhattan.

Illustratively, air supply unit 12 includes a body 34 having a first channel 35 and a front receiving portion 36. First connector 18 includes a first wall 40 configured to align with front receiving portion 36 and a second wall 42 adapted to be placed in channel 35 to hold first connector 18 in contact with body 34. As shown in FIG. 1, first connector 18 couples connector assembly 14 to air supply unit 12 at an angle 38 of between about 5° and about 45°. Other angles are within the scope of the present disclosure.

Figure 2:
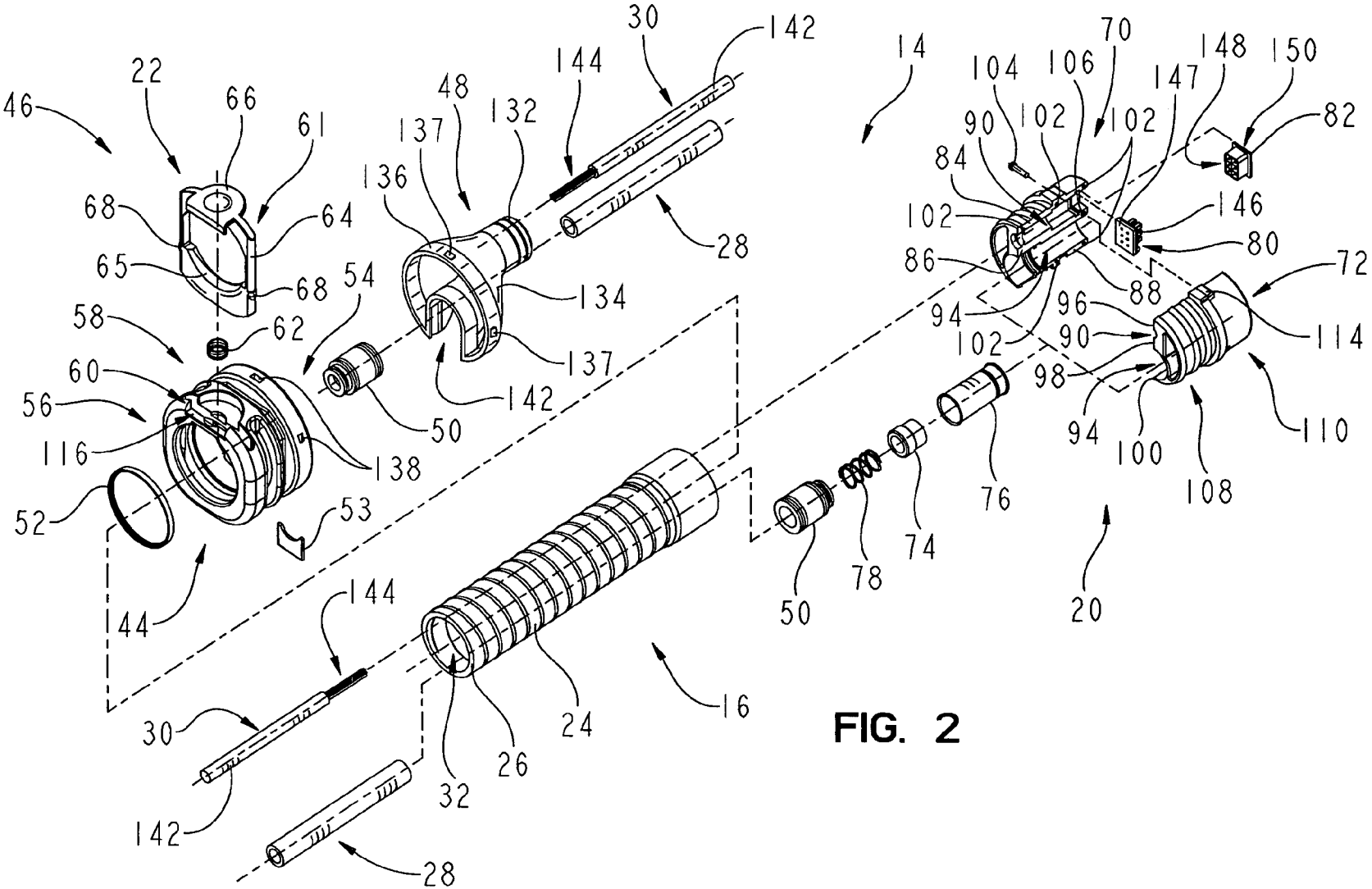
FIG. 2 is an exploded view of the connector assembly and the hose of FIG. 1.
Figure 3:
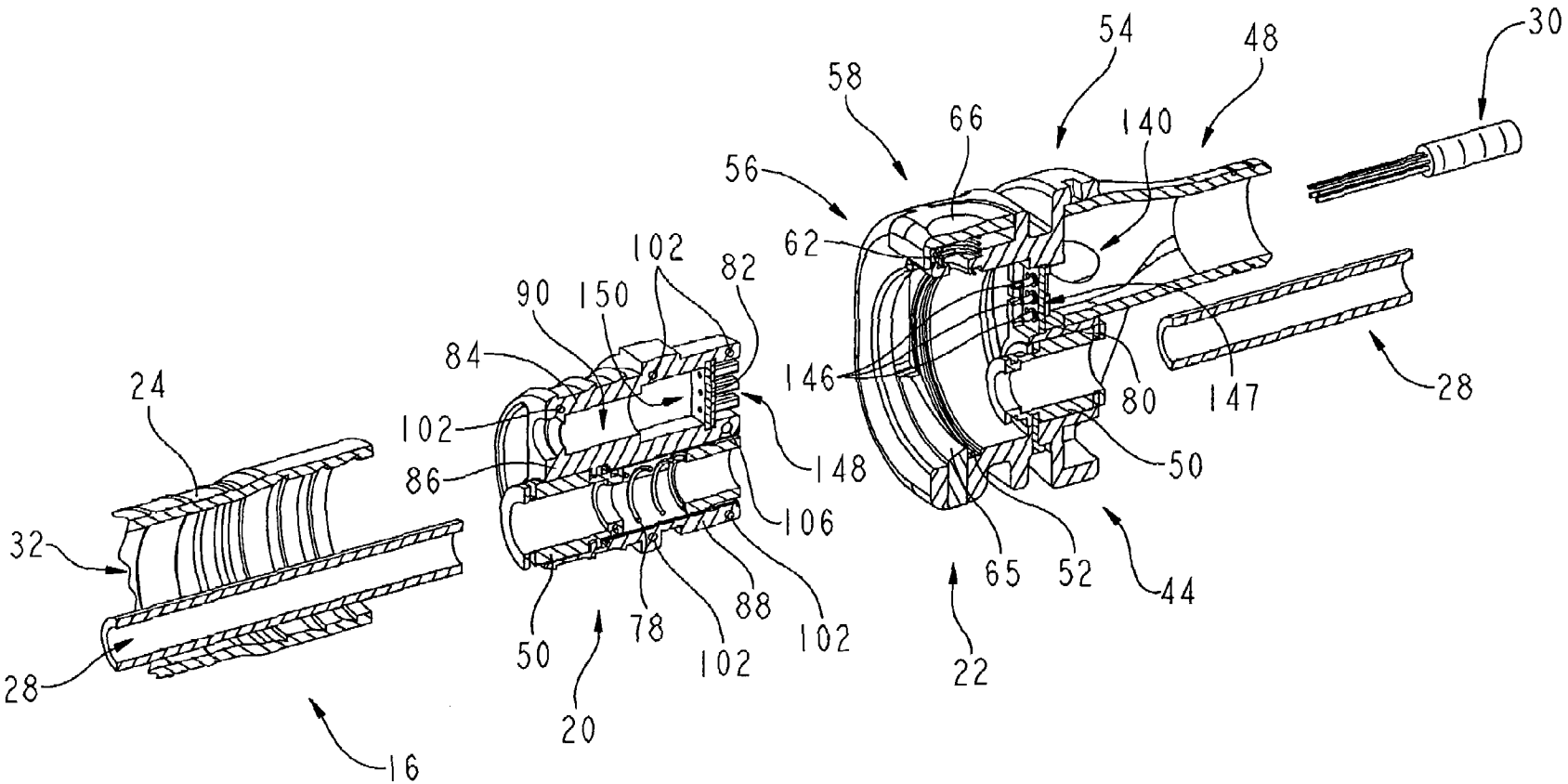
FIG. 3 is an exploded cutaway view of the connector assembly and the hose of FIG. 1.

As shown in FIGS. 2 and 3, connector body 22 includes a main body 44, a button assembly 46, a cone 48, a tube insert 50, and an air seal 52. Tube insert 50 is held in main body 44 by a staple 53. One example of a suitable tube insert 50 is Part Number VVQ4000-50B-C12 manufactured by SMC Corporation of America.

Main body 44 includes a first side or cone side 54, a second side or hose side 56, and a central body 58. Central body 58 includes a button slot 60 configured to receive button assembly 46. Button assembly 46 includes a button slide 61 configured to cooperate with button slot 60 and a spring 62 configured to support button slide 61 in button slot 60. Button slide 61 includes a slide body 64, a ramp 65 and a release switch 66. Slide body 64 includes a pair of slide tabs 68 located on the sides of slide body 64 as shown. Slide tabs 68 are configured to hold button slide 61 in button slot 60. Slide tabs 68 cooperate with central body 58 by allowing button slide 61 to be placed in button slot 60 and prevents button slide 61 from being removed from button slot 60 by creating a positive lock between slide tabs 68 and central body 58.

Second connector 20 includes a first connector portion 70, a second connector portion 72, a spring button 74, a spring tube 76 configured to receive spring button 74, a compression spring 78 configured to cooperate with spring button 74, tube insert 50, a male pin connector 80, and a female pin connector 82 configured to receive male pin connector 80.

Figure 5:
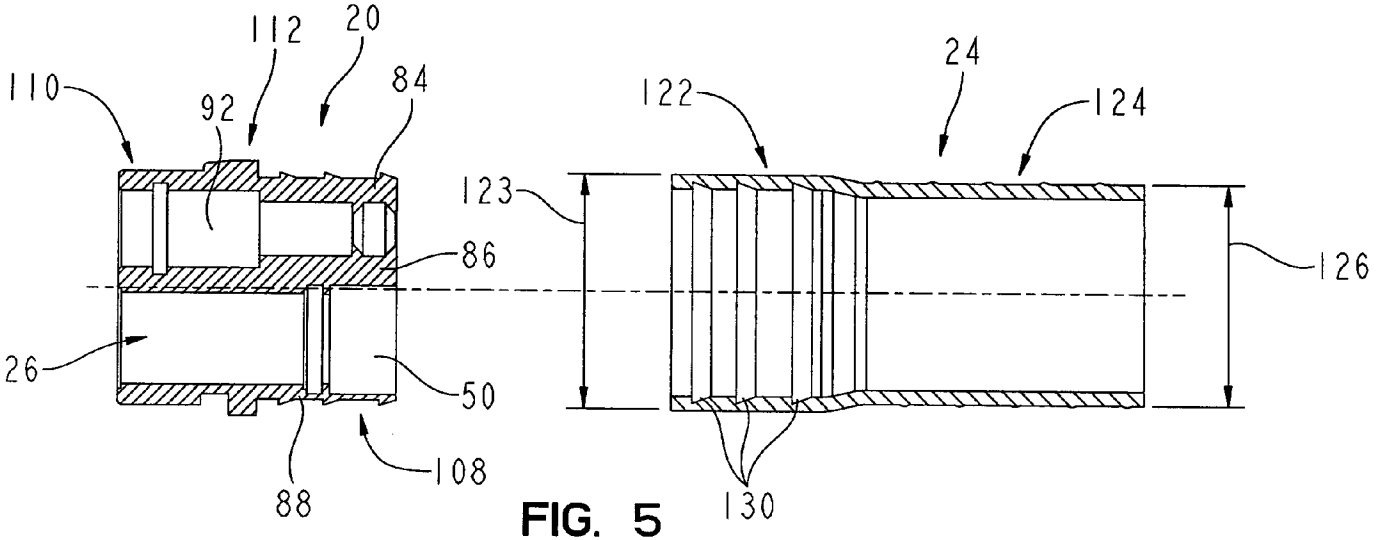
FIG. 5 is a cutaway side view of the hose and the hose end of FIG. 4.

First connector portion 70 includes a first upper wall 84, a first center wall 86 and a first lower wall 88. First upper wall 84 and first center wall 86 cooperate to define an electrical channel 90 configured to receive a plug 92, as shown in FIG. 5. First lower wall 88 and first center wall 86 cooperate to form secondary hose channel 94 configured to receive secondary hose 28 and tube insert 50.

Second connector portion 72 includes a second upper wall 96, a second center wall 98, and a second lower wall 100. Second connector portion 72 further includes electrical channel 90 and secondary hose channel 94.

As shown in FIGS. 2 and 3, first upper wall 84 and first lower wall 88 include a plurality of tabs 102. The plurality of tabs 102 correspond to a plurality of holes (not shown) on second upper wall 96 and second lower wall 100. Tabs 102 and holes (not shown) cooperate so that first connector portion 70 and second connector portion 72 couple together. When coupled, first and second portions bodies 70, 72 are held in place by one or more screws or other suitable fasteners 104 that cooperate with one or more holes 106 in first and second connector portions 70, 72.

Figure 4:
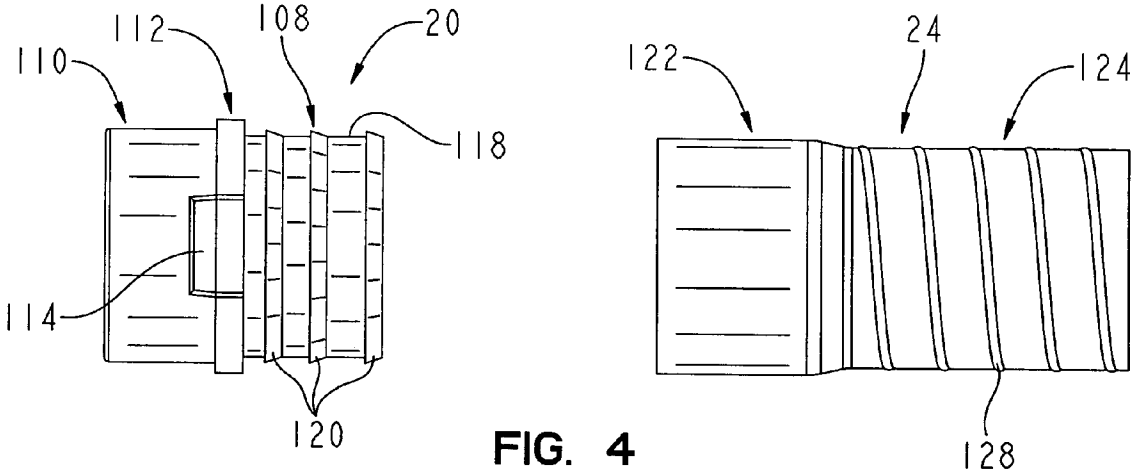
FIG. 4 is a side view of the hose of FIG. 1 and a hose end.

As shown in FIGS. 4 and 5, second connector 20 further includes a first hose receiving section 108, a second section 110 configured to be received by main body 44, and a coupler section 112. First hose receiving section 108 includes a body portion 118 and a plurality of ribs 120.

Main hose 24 includes a first section 122 of a first diameter 123 and a second section 124 of a second diameter 126. Second diameter 126 is smaller than first diameter 123. Main hose 24 may be a corrugated hose, with or without witness lines 128 showing, and may be configured so that the "spring" of the hose is internally located.

First section 122 of main hose 24 includes internal rib channels 130. Rib channels 130 correspond to and cooperate with ribs 120 of second connector 20 to hold the main hose in connection with second connector 20. First section 122 is at least one wall thickness smaller than first hose section 108. First section 122 is stretched and placed around hose section 108 to hold main hose 24 in place and aid in holding second connector 20 together.

Coupler section 112 of second connector 20 includes a coupler tab 114 configured to correspond with a coupler opening 116 defined in main body 44, as shown in FIGS. 1 and 4. Coupler tab 114 is configured to allow the hose to couple with main body 44 in only one direction.

In one illustrative embodiment shown in FIGS. 2 and 3, cone 48 is substantially hollow and includes an inlet portion 132 configured to couple to an air source (not shown), a curved body portion 134, and a base portion 136 including a plurality of cone tabs 137. Cone tabs 137 correspond to a plurality of cone slots 138 on main body 44 in order to couple cone 48 to main body 44. Cone 48 further includes a cable opening 140 operable to receive data cable 30 and a secondary hose slot 142 operable to allow secondary hose 28 to pass between cone 48 into main body 44. Cable opening 140 is a substantially cone shaped hole which has a larger opening on the inside of cone 48 then on the outside of cone 48 to allow data cable 30 to seal cable opening 140 when data cable 30 is placed through cable opening 14.

Data cables 30 include an outer shell 142 and a wire portion 144. Outer shell 142 protects wire portion 144 from moisture and from making contact with other objects. Male pin connector 80 includes a plurality of pins 146 and a pin backing 147 operable to couple to wire portion 144 to make electrical contact. Female pin connector 82 includes a pin receiving portion 148 configured to receive pins 146 when hose connector 20 is coupled to main body 44 and a circuit board backing 150 operable to be soldered to plug 92. When pins 146 are in contact with pin receiving portion 148 they are shielded from touch. This allows a user to touch male pin connector 80 or female pin connector 82 without contacting an electrical current flowing through wire portion 144.

Illustratively in operation, main hose 24 is placed over second connector 20. A user (not shown) aligns coupler tab 114 with coupler opening 116 and pushes second connector 20 into main body 44. As the user (not shown) pushes second connector 20 into main body 44, second connector 20 contacts ramp 65. The contact with ramp 65 pushes button slide 61 downwards compressing spring 68 downwards. Once second connector 20 is in pushed fully into position spring 68 forces button slide 61 backing into position locking second connector 20 in place. To remove hose connector from main body 44, the user (not shown) depresses release switch 66 which compresses spring 62 and moves button slide 61. This causes spring button 74 to depress spring 78 to force hose connector 22 out from main body 44. Alternatively if no spring button 74 was used, in order to allow removal the user (not shown) would need to pull second connector 20 from main body 44 after button slide 61 was moved. It may not be necessary for the user to actually pull hose connector 20 from main body 44 because air pressure will aid in removal.

Figure 6:
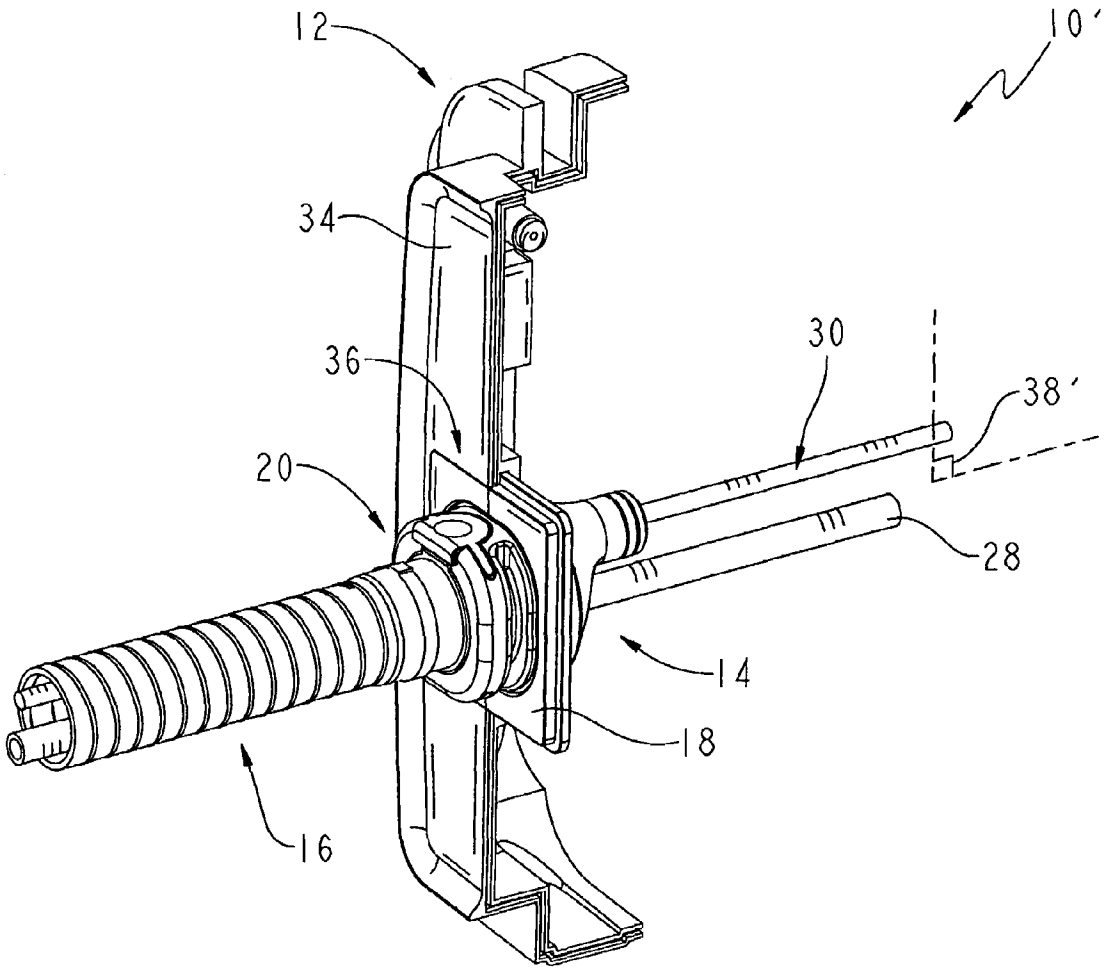
FIG. 6 is a perspective view of another configuration of the connector assembly of FIG. 1 coupled to the supply box at a 90° angle.

Another illustrative embodiment of connector apparatus 10 is shown in FIG. 6. Connector apparatus 10' is substantially similar to connector apparatus 10. The only substantial difference is angle 38' of connector device with respect to an unit 12 is about 90°. All other components are the same.

Figure 7:
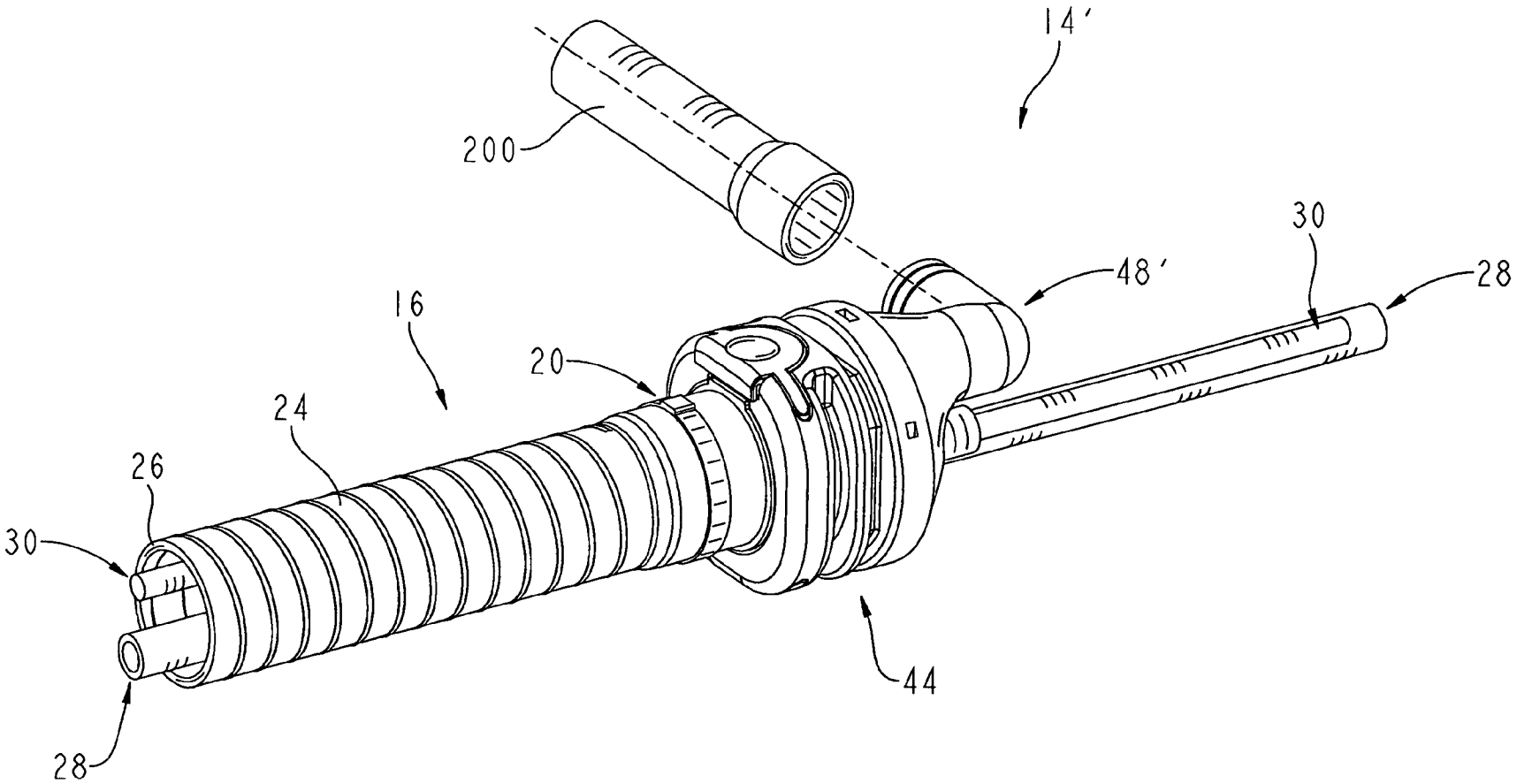
FIG. 7 is a perspective view of a second embodiment of the connector assembly.
Figure 8:
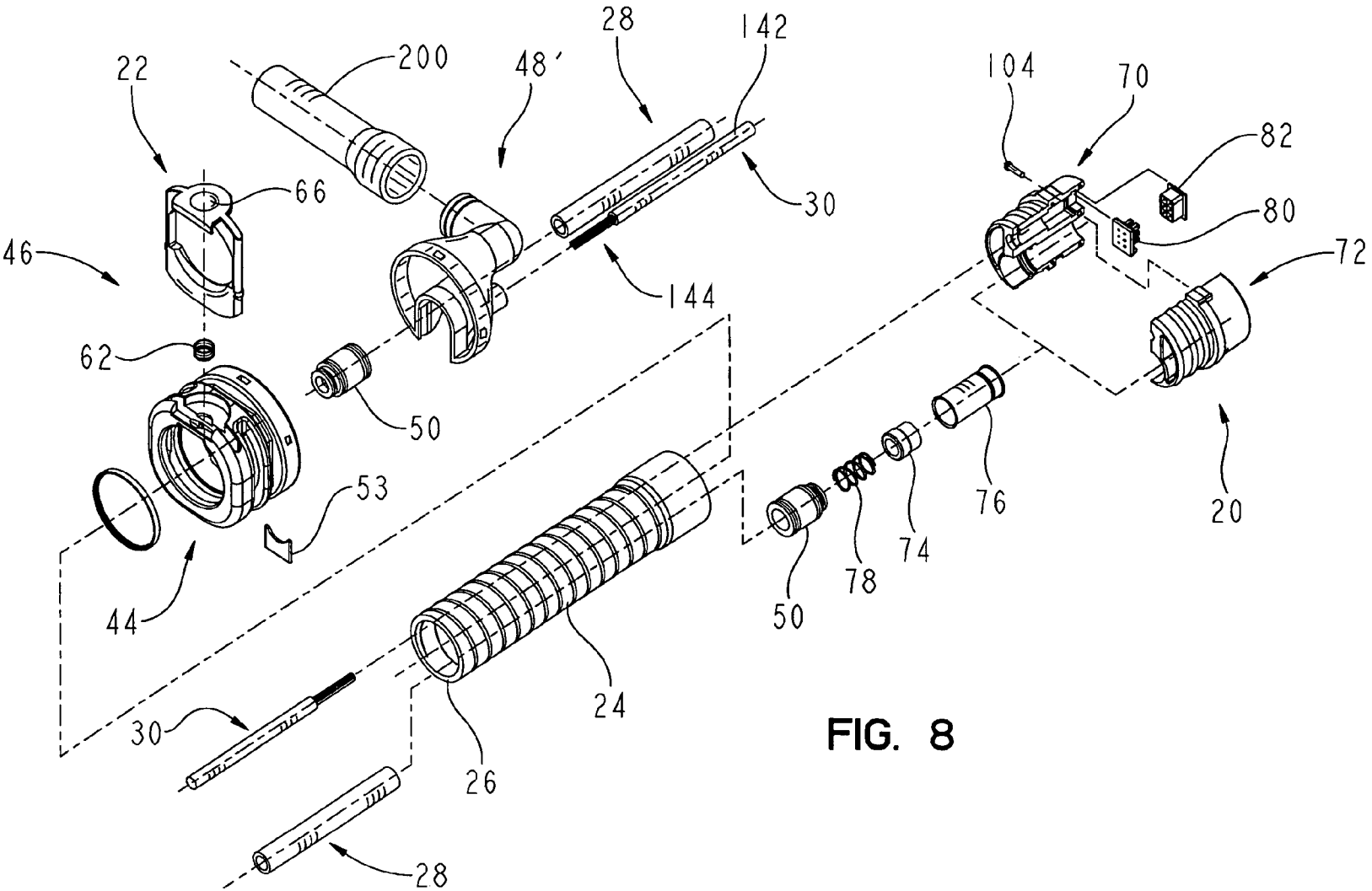
FIG. 8 is an exploded perspective view of the connector assembly of FIG. 7.
Figure 9:
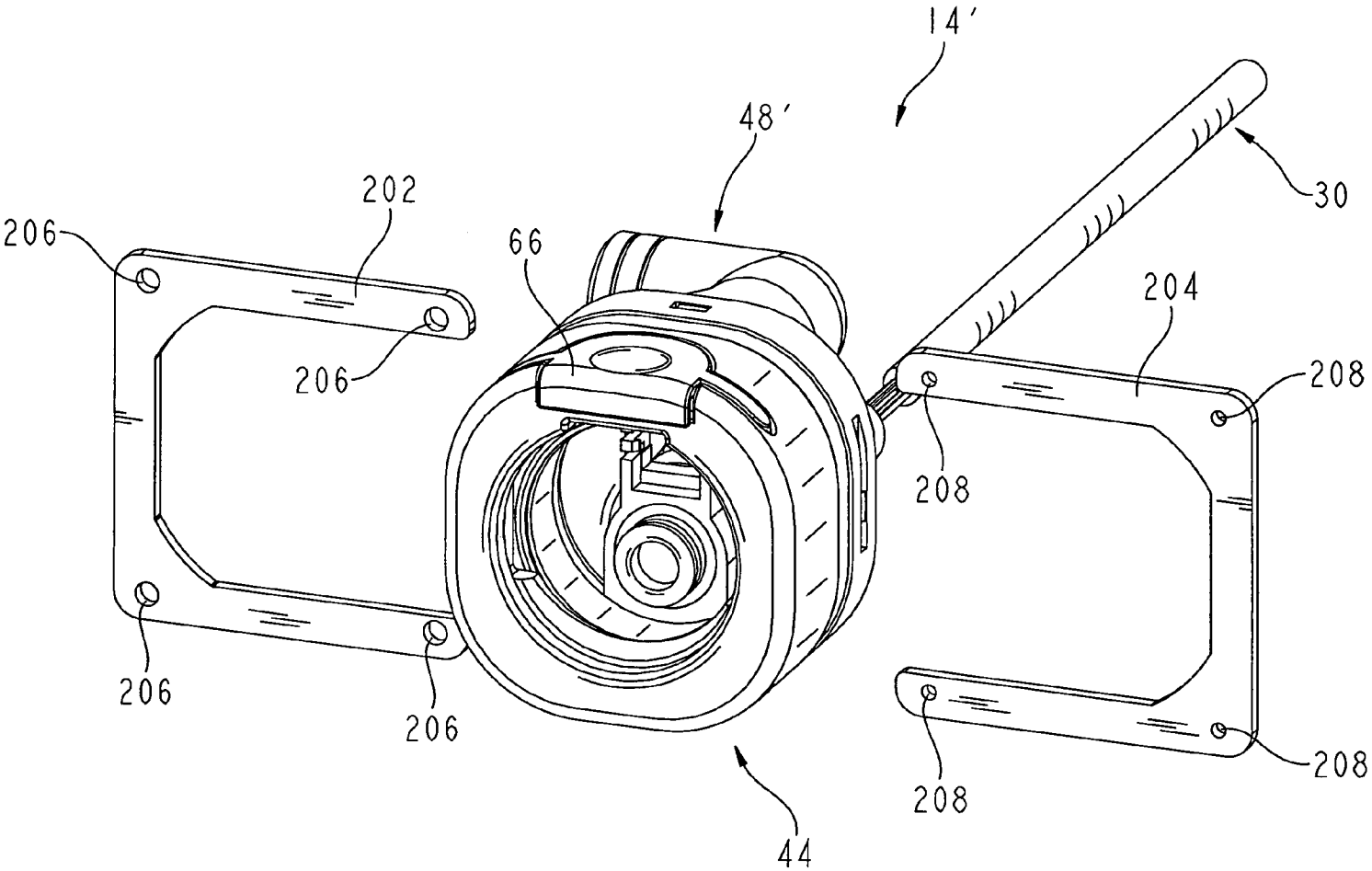
FIG. 9 is a perspective view of the connector assembly of FIG. 7 including a mattress clamp.

In another illustrative embodiment, a connector assembly 14' is provided for use with a mattress (not shown), as shown in FIGS. 7-9. Connector assembly 14' is substantially similar to connector assembly 14. Connector assembly 14' includes a 90° cone 48' configured to couple to a high volume low pressure supply line 200. The 90° cone 48' allows supply line 200 to bend upon entering a mattress or cushion (not shown).

Connector assembly 14' further includes a first mattress clamp 202 and a second mattress clamp 204 as shown in FIG. 9. First mattress clamp 202 is located on an interior portion of the mattress and second mattress clamp 204 is located on an exterior portion of the mattress or cushion. In this embodiment, first and second mattress clamps 202, 204 cooperate with main body 44 in place of first connectors 18 to hold main body 44 in place. Fasteners (not shown) are provided for corresponding first holes 206 on first mattress clamp 202 and second holes 208 on second mattress clamp 204. First holes 206 have a larger diameter them second holes 208. As illustrated, first and second clamps 202, 204 are configured to overlap with the mattress in between the clamps 202, 204.

Illustratively, connector assembly 14 and connector assembly 14' are used on opposite ends of the same main hose 24. This allows a single connector assembly to be manufactured saving time and cost. It also allows the user (not shown) to disconnect main hose 24 from either the mattress (not shown) or from air supply unit 12.

Figure 10:
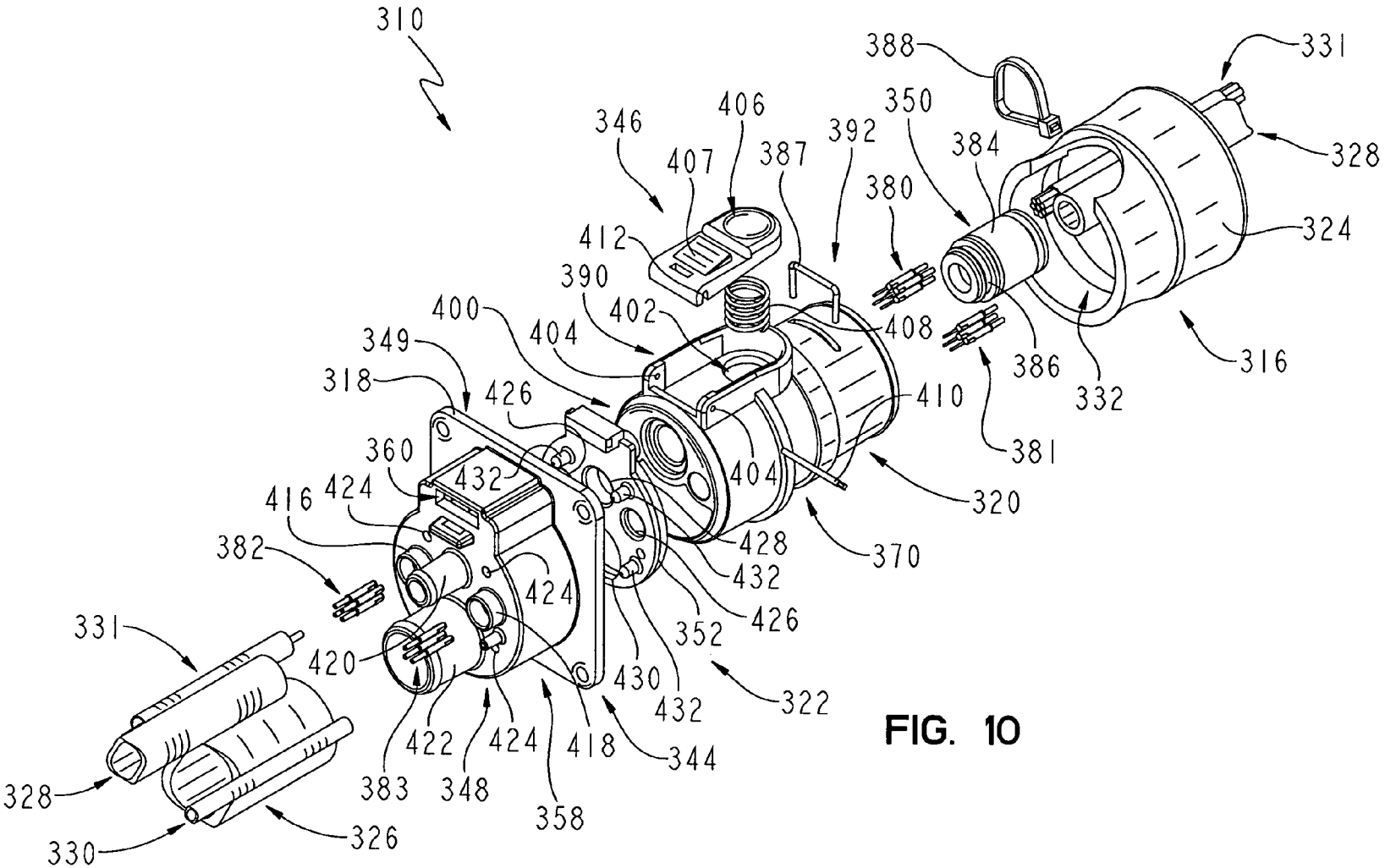
FIG. 10 is a perspective view of a third embodiment of a connector assembly.

Another illustrative embodiment of a connector apparatus 310 is shown in FIG. 10. Connector apparatus 310 includes an air supply unit (not shown), a connector assembly 314 coupled to the air supply unit (not shown), and a hose assembly 316 coupled to connector assembly 314. Connector assembly 314 includes a box connector 318, a hose connector 320, and a connector body 322 configured to couple to box connector 318. Hose assembly 316 includes a main hose 324 including a low pressure high volume hose 326, a high pressure hose 328, a first data cable 330, and a second data cable 331. First and second data cables 330, 331, low pressure hose 326, and high pressure hose 328 pass within an inner region 332 of main hose 324. High pressure hose 328 is configured to provide high pressure air to the mattress or cushion (not shown). Low pressure, high volume air is provided through low pressure hose 324, i.e., for low air loss therapy in the mattress (not shown). First and second data cables 330, 331 are configured to provide electrical communication including power and network communication to the mattress (not shown).

Hose connector 320 includes a connector housing 370, a button assembly 346, a tube insert 350, a first male pin connector 380, a second male pin connector 381, a first female pin connector 382, and a second female pin connector 483. First and second female pin connectors 382, 383 are configured to receive first and second male pin connectors 380, 381. Tube insert 350 includes an insert body 384 and a groove 386. A fitting coupler 387 is provided to cooperate with tube insert 350 to hold tube insert 350 in place, as shown in FIG. 10. Tube insert 350 is configured to receive high pressure hose 328. Data cables 330, 331 are held in place against tube insert 350 by a tie wrap 388 configured to fit in groove 386. Tie wrap 388 is synched tight to hold data cables 330, 331 in place. One example of tube insert 350 is Part Number VVQ4000-50B-C12 manufactured by SMC Corporation of America.

Connector housing 370 includes a button support 390, a hose receiving side 392 and a connector body receiving side 400. Hose receiving side 392 is larger in diameter than inner region 322 in order to hold main hose 316 in place. Button support 390 includes a spring retainer 402 and a pair of hinge holes 404.

Figure 12:
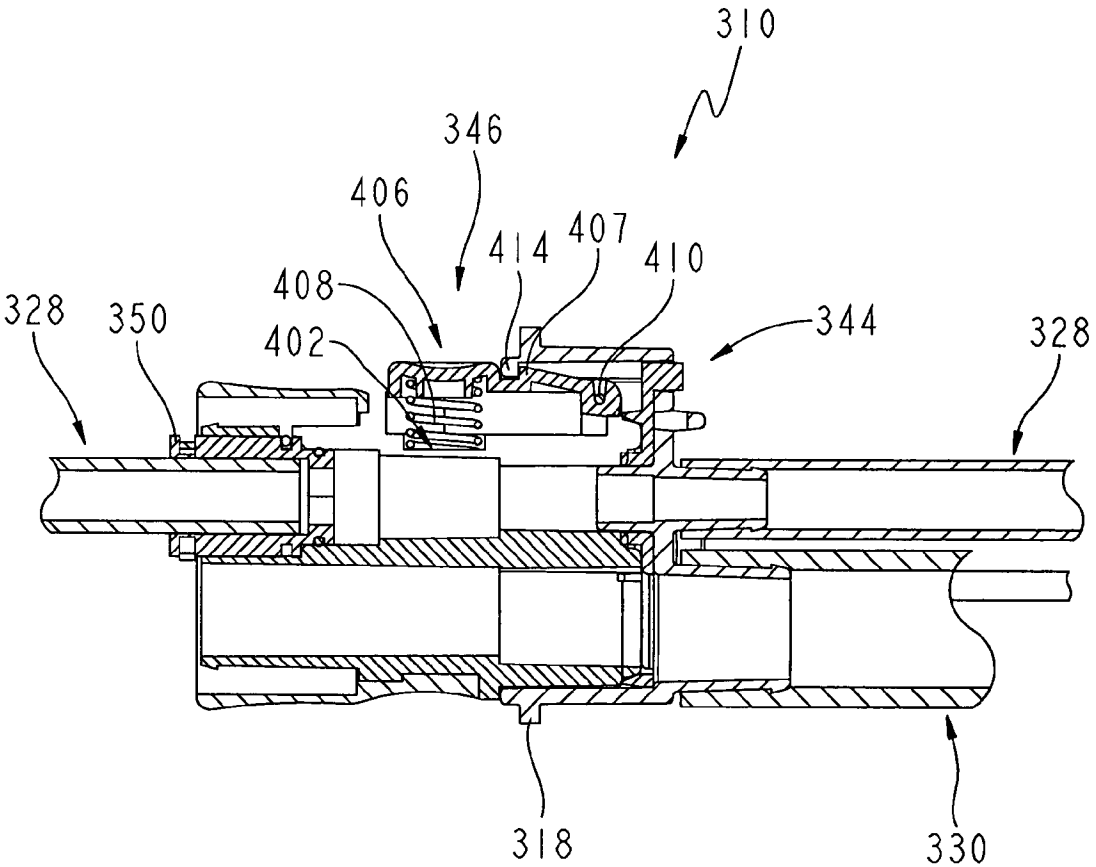
FIG. 12 is a side cutaway view of the connector assembly of FIG. 10.

Button assembly 346 includes a button 406, a latch portion 407, a button spring 408, and a hinge pin 410. Button 406 includes a hinge slot 412 configured to receive hinge pin 410. Button spring 408 is placed in spring retainer 402. As shown in FIG. 12, hinge pin 410 operably connects button 406 to button support 390 by sliding through hinge holes 404 and hinge slot 412.

As shown in FIG. 10, connector body 322 includes a main body 344 and an air seal 352. Main body 344 includes a first side or supply side 348, a second side or hose side 349, and a central body 358. Central body 358 includes a button slot 360 configured to receive button assembly 346.

As shown in FIG. 10, supply side 348 includes a first pin protector 416, a second pin protector 418, a high pressure connector 420, a low pressure connector 422, and a plurality of gasket openings 424. First and second pin protectors 416, 418 are configured to receive first and second female pin connectors 382, 383. Pin protectors 416, 418 are configured to prevent unwanted contact with electrical current flowing through first and second female pin connectors 382, 383.

Hose side 349 is configured to receive air seal 352. Air seal 352 includes a pair of data cable openings 426, a high pressure opening 428, a low pressure opening 430, and a plurality of gasket projections 432. Data cable openings 426 are configured to correspond to first and second pin protectors 416, 418 when air seal 352 is pressed against main body 344. Low pressure opening 428 and high pressure opening 430 are configured to correspond to low pressure connector 422 and high pressure connector 420 when air seal 352 is pressed against main body 344. Gasket openings 424 are configured to receive gasket projections 432 when air seal 352 is pressed against main body 344. Gasket projections 432 are sized larger than gasket openings 424 in order to hold air seal 352 in place to form an air tight seal.

Figure 11:
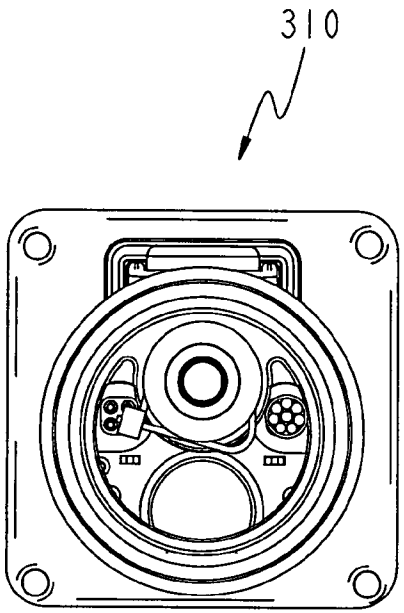
FIG. 11 is a front view of the connector assembly of FIG. 10.

FIG. 11 illustrates a front view of the connector assembly of FIG. 10.

As shown in FIG. 12, button assembly 346 slides into button slot 360. As a user (not shown) slides hose connector 320 into connector body 322, button assembly 346 slides into button slot 360 button spring 408 compresses. When button latch 407 is received fully into button slot 360 button spring 408 forces button latch 407 against a tab 414 of button slot 360 to lock button assembly 346 and hose connector 320 into connector body 322.

Figure 13:
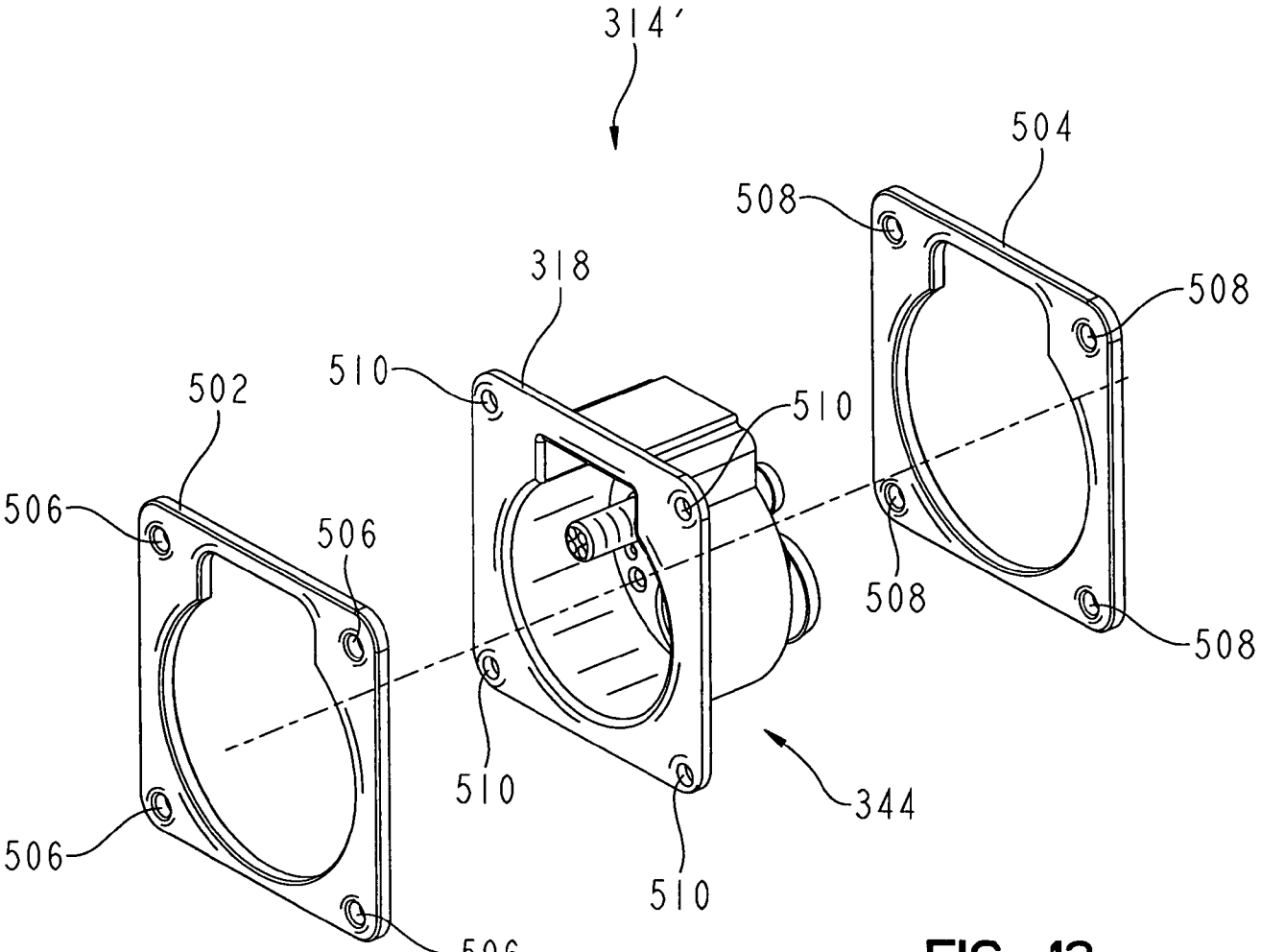
FIG. 13 is a perspective view of another embodiment of a connector assembly including a mattress clamp.

In another illustrative embodiment, a connector assembly 314' is provided for use with a mattress (not shown), as shown in FIG. 13. Connector assembly 314' is substantially similar to connector assembly 314. Connector assembly 314' includes a first mattress clamp 502 and a second mattress clamp 504. First mattress clamp 502 is located on the interior portion of the mattress (not shown) and second mattress clamp 504 is located on the exterior. First and second mattress clamps 502, 504 cooperate with main body 344 in to hold main body 344 in place. Fasteners (not shown) are provided for corresponding first holes 506 on first mattress clamp 502, second holes 508 on second mattress clamp 504, and third holes 510 on box connector 318. First and second clamps 502, 504 are configured to hold the mattress between first clamp 502 and box connector 318.

Illustratively, connector assembly 314 and connector assembly 314' are used on opposite ends of the same main hose 324. This allows a single connector assembly to be manufactured saving time and cost. It also allows the user (not shown) to disconnect main hose 24 from either the mattress (not shown) or from supply unit (not shown).

Figure 14:
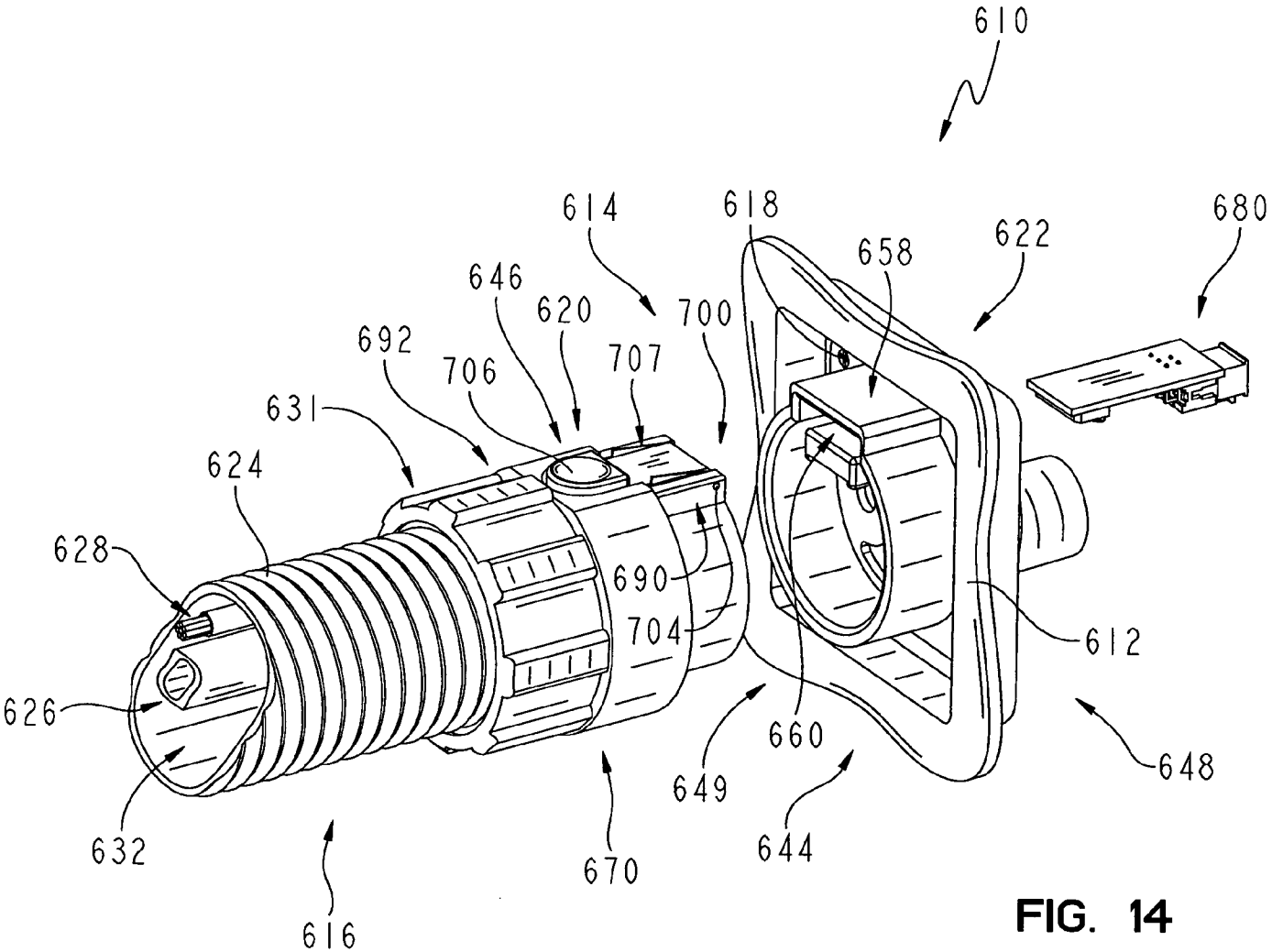
FIG. 14 is a perspective view of another embodiment of the connector device, the connector device including a connector assembly and a hose assembly.

Another illustrative embodiment of a connector apparatus 610 is shown in FIG. 14. Connector apparatus 610 includes an air supply unit or mattress 612, a connector assembly 614 coupled to the air supply unit 612, and a hose assembly 616 coupled to connector assembly 614. Connector assembly 614 includes a box connector 618, a hose connector 620, and a connector body 622 configured to couple to box connector 618. Hose assembly 616 includes a main hose 624 including a low pressure high volume hose 626, a high pressure hose 628, a data cable 630, and a connector nut 631. Data cable 630, low pressure hose 626, and high pressure hose 628 pass within an inner region 632 of main hose 624. High pressure hose 628 is configured to provide high pressure air to the mattress. Low pressure, high volume air is provided through low pressure hose 624, i.e., to provide for low air loss therapy in the mattress. Data cable 330 is configured to provide electrical communication including power and network communication to the mattress (not shown).

Hose connector 620 includes a connector housing 670 and a button assembly 646. Connector housing 670 includes a button support 690, a hose receiving side 692 and a connector body receiving side 700. Connector nut 631 includes a threaded portion (not shown) and is operable to couple to a threaded portion (not shown) of hose receiving side 692. Button support 690 includes a spring retainer (not shown) and a pair of hinge holes 704.

Button assembly 646 includes a button 706, a latch portion 707, a button spring (not shown), and a hinge pin (not shown). Hinge pin (not shown) operably connects button 706 to button support 690 by sliding through hinge holes 704 and a hinge slot (not shown).

As shown in FIG. 14, connector body 622 includes a main body 644. Main body 644 includes a first side or supply side 648, a second side or hose side 649, and a central body 658. Central body 658 includes a button slot 660 configured to receive button assembly 646.

As shown in FIG. 14, button assembly 646 slides into button slot 660. As a user (not shown) slides hose connector 620 into connector body 622, button assembly 646 slides into button slot 660 button spring (not shown) compresses. When button latch 707 is received fully into button slot 660 button spring (not shown) forces button latch 707 against a tab (not shown) of button slot 660 to lock button assembly 646 and hose connector 620 into connector body 622. A circuit board 680 is configured to couple to data cable 630 when hose connector 620 is coupled to connector body 622. Circuit board 680 passes through connector body 620 under button slot 660 and into a circuit board nest (not shown). When circuit board 680 is in nest (not shown) it is operably coupled to data cable 628.

Preferably, instructions for the assembly, installation, and/or use of connector apparatuses 10, 10', 310, 310' and 610 are provided with connector apparatus 10, 10', 310, 310' and 610 or otherwise communicated to permit a person or machine to assemble, install and/or use connector apparatus 10, 10', 310, 310' and 610. Such instructions may include a description of any or all portions of connector apparatus 10, 10', 310, 310' and 610 and/or any or all of the above-described assembly, installation, and use of connector apparatus 10, 10', 310, 310' and 610 or components of connector apparatus 10, 10', 310, 310' and 610. The instructions may be provided on separate papers and/or on the packaging in which connector apparatus 10, 10', 310, 310' and 610 is sold or shipped. These instructions may also be provided over the Internet or other communication system. Furthermore, the instructions may be embodied as text, pictures, audio, video, or any other medium or method of communicating instructions known to those of ordinary skill in the art.

Although the invention has been described in detail with reference to certain preferred embodiments, variations and modifications exist within the scope and spirit of the present invention.

The invention claimed is:

1. A connector apparatus comprising: an air supply unit; a connector assembly coupled to the air supply unit; and a hose assembly coupled to the connector assembly, the hose assembly including a first air hose, a second air hose, and a data cable, wherein both the second air hose and the data cable are located at least partly within an inner region of the first hose, the connector assembly includes a button slot, a first side, and a second side; and the second air hose is located outside the first air hose on the first side and the second air hose is located within the inner region of the first air hose on the second side.

2. The connector apparatus of claim 1, wherein the first air hose is a high volume, low pressure air hose.

3. The connector apparatus of claim 2, wherein the second air hose is a high pressure air hose.

4. The connector apparatus of claim 3, wherein the data cable is an electrical communication cable.

5. The connector apparatus of claim 4, wherein the data cable is a power cable.

6. The connector apparatus of claim 4, wherein the data cable is a network cable.

7. The connector apparatus of claim 1, wherein the connector assembly includes a quick connector.

8. The connector apparatus of claim 1, wherein the hose assembly includes a button assembly and the button slot is configured to receive the button assembly.

9. The connector assembly of claim 1, further comprising a circuit board.

10. A connector apparatus to couple an air supply apparatus to a mattress comprising: a connector assembly coupled to the air supply apparatus; and a hose assembly, coupled to the connector assembly, including a first air hose having an interior region, and a second air hose and a cable both of which are located at least partly within the interior region of the first air hose; wherein the connector assembly includes a body, including a first air hose connector, a second air hose connector and a cable connector; wherein the connector assembly further comprises a first side and a second side, and the second air hose is located outside the first air hose on the first side and the second air hose is located within the interior region of the first air hose on the second side.

11. The connector apparatus of claim 10, wherein the connector assembly first side includes a first inlet for the first air hose, a second inlet for the second air hose, and a third inlet for the cable, wherein the third inlet is located within the first inlet.

12. The connector apparatus of claim 11, wherein the connector assembly second side includes a first outlet for the first air hose, a second outlet for the second air hose, and a third outlet for the cable, wherein the second outlet and the third outlet are located within the first outlet.

13. The connector apparatus of claim 12, wherein the cable includes a first portion and second portion, the first portion being coupled to the third inlet and the second portion being coupled to the third outlet.

14. The connector apparatus of claim 13, wherein the third inlet and the third outlet comprise an electrical connector.

15. A connector apparatus to connect an air supply unit to an inflatable mattress including a low air loss therapy device, the connector apparatus comprising: a connector assembly, coupled to the air supply unit; and a hose assembly, coupled to the connector assembly, the hose assembly including a first hose, a second hose, and a cable, wherein the first hose is adapted to be coupled to the low air loss therapy device, to supply air thereto, the second hose is adapted to be coupled the inflatable mattress for inflation thereof, and the cable is adapted to be coupled to the mattress to provide electrical communication thereto; and wherein the hose assembly comprises a first air hose having an interior region, the second air hose and the cable are located at least partly within the interior region of the first air hose; the connector assembly comprises a first side and a second side, the second air hose is located outside the first air hose on the first side and the second air hose is located within the interior region of the first air hose on the second side.

16. The connector apparatus of claim 15, wherein the cable is located outside the first air hose on the first side.

17. The connector apparatus of claim 10, wherein the connector assembly comprises a first connector and a second connector.

18. The connector apparatus of claim 17, wherein the first connector comprises a button assembly configured to engage the second connector in a positive lock with the first connector.

19. The connector apparatus of claim 18, wherein the button assembly includes a release switch biased to a first position positively locking the first connector with the second connector and movable to a second position releasing the first connector from positively locking with the second connector.

20. The connector apparatus of claim 19, wherein the connector assembly includes a spring button biasing the second connector away from the first connector when the second connector is released from positively locking with the first connector.

* * * * *

UNITED STATES PATENT AND TRADEMARK OFFICE

CERTIFICATE OF CORRECTION

PATENT NO. : 7,648,392 B2
APPLICATION NO. : 11/300667
DATED : January 19, 2010
INVENTOR(S) : Chambers et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1011 days.

Signed and Sealed this

Sixteenth Day of November, 2010

David J. Kappos

David J. Kappos
*Director of the United States Patent and Trademark Office*